US009416980B2

(12) United States Patent
Yan et al.

(10) Patent No.: US 9,416,980 B2
(45) Date of Patent: Aug. 16, 2016

(54) ECONOMICALLY-OPERATED, DUAL-ENERGY HOT WATER SUPPLY SYSTEM AND METHOD OF OPERATING THE SAME

(75) Inventors: Song Yan, Nanjing (CN); Gongli Cong, Nanjing (CN)

(73) Assignee: A. O. SMITH CORPORATION, Milwaukee, WI (US)

( * ) Notice: Subject to any disclaimer, the term of this patent is extended or adjusted under 35 U.S.C. 154(b) by 748 days.

(21) Appl. No.: 13/241,494

(22) Filed: Sep. 23, 2011

(65) Prior Publication Data

US 2012/0090559 A1 Apr. 19, 2012

(30) Foreign Application Priority Data

Sep. 30, 2010 (CN) ..... 2010 1 0297968

(51) Int. Cl.

*F24H 9/20* (2006.01)
*F24D 17/00* (2006.01)
*F24D 17/02* (2006.01)
(Continued)

(52) U.S. Cl.

CPC ..... *F24D 17/0031* (2013.01); *F24D 17/02* (2013.01); *F24D 19/1054* (2013.01); *F24D 19/1063* (2013.01); *F24D 2200/043* (2013.01); *F24D 2200/12* (2013.01); *F24D 2200/32* (2013.01); *F24H 1/205* (2013.01); *F24H 4/04* (2013.01); *F24H 9/2035* (2013.01)

(58) Field of Classification Search

CPC ..... F24H 4/04; F24H 1/205; F24H 1/186; F24H 9/2035; Y02B 30/12; F23N 1/087; F23N 2035/14; F23N 2035/20; F23M 2900/11021; F23D 14/72; F24D 17/02; F24D 17/0031; F24D 19/1054; F24D 19/1063; F24D 2200/043; F24D 2200/12; F24D 2200/32

USPC ..... 122/14.2, 14.21

See application file for complete search history.

(56) References Cited

U.S. PATENT DOCUMENTS 4,391,104 A * 7/1983 Wendschlag ..... 62/79
4,420,034 A * 12/1983 VanderVaart ..... 165/240
(Continued)

FOREIGN PATENT DOCUMENTS

CN 201311081 9/2009
CN 201421194 3/2010

OTHER PUBLICATIONS

Perry, Robert H, "Perry's Chemical Engineers' Handbook", 1997, Seventh Edition, pp. (2-195-2-200).*
(Continued)

*Primary Examiner* — Stephen B. Mcallister
*Assistant Examiner* — Steven Anderson, II
(74) *Attorney, Agent, or Firm* — Michael Best & Friedrich LLP

(57) ABSTRACT

An economically operated, dual-energy hot water supply system. The system includes a first heat source of a first type and a second heat source of a second type different than the first type. The system also includes a controller. The controller determines a first energy consumption of the first heat source to generate a unit heat, determines a second energy consumption of the second heat source to generate the unit heat, compares a first power cost of the first heat source with a second power cost of the second heat source, the first power cost being based on the first energy consumption and the first price, the second power cost being based on the second energy consumption and the second price.

11 Claims, 4 Drawing Sheets

(51) Int. Cl.

| | |
|---|---|
| ***F24D 19/10*** | (2006.01) |
| *F24H 1/20* | (2006.01) |
| *F24H 4/04* | (2006.01) |

(56) References Cited

U.S. PATENT DOCUMENTS

| | | | | |
|---|---|---|---|---|
| 4,943,003 | A * | 7/1990 | Shimizu et al. | 237/2 B |
| 4,971,136 | A * | 11/1990 | Mathur et al. | 165/240 |
| 4,976,464 | A * | 12/1990 | Swenson | 237/81 |
| 6,283,067 | B1 * | 9/2001 | Akkala | 122/14.22 |
| 2005/0109387 | A1 * | 5/2005 | Marshall | 136/253 |
| 2005/0229871 | A1 * | 10/2005 | Robertson | 122/32 |

OTHER PUBLICATIONS

R. Nave, Heat Pump, "http://hyperphysics.phy-astr.gsu.edu/hbase/thermo/heatpump.html", Aug. 19, 2010, pp. 1-4.*

Doron Levy, Numerical Analysis, Mar. 4, 2008, pp. 74-76.*

Yoshiaki Shibata et al., "The CO2 Heat Pump Water Heater as a New Countermeasure Against Global Warming: Drastic Improvement in Energy Efficiency in Three Years Since Its Debut", 2006, 1-293 to 1-295.*

* cited by examiner

ECONOMICALLY-OPERATED, DUAL-ENERGY HOT WATER SUPPLY SYSTEM AND METHOD OF OPERATING THE SAME

BACKGROUND

This invention relates to a dual-energy hot water supply system. In a more specific embodiment, the invention relates to an economically-operated, dual-energy hot water supply system and its operating method.

In the past few years, hot water supply systems combine gas water heaters and heat pump water heaters. For example, Chinese patent application no. 200820202823.2 discloses a heat pump water heater with a gas auxiliary heating unit. The system includes a confined water tank, a control device, and outlet piping. The mentioned gas auxiliary heating unit is installed in series with the outlet piping of the confined water tank. The downdraft temperature probe, water flow sensor, and gas control valve are connected to the control unit respectively. The system is characterized by compensating the heat pump effectively in the insufficient heat supply conditions and expanding the applicable areas of the heat pump water heater. For another example, Chinese patent application no. 200920300786.3 discloses a solar water heater with two auxiliary heating methods, i.e. a heat pump water heater and a gas water heater. The system integrates the advantages of the gas water heater and heat pump water heater, and avoids their disadvantages.

SUMMARY

However, as for the heating method changeover, the prior technology only takes into consideration the additional heating, but fails to make the hot water supply system more economical from the view of saving operating cost.

In at least one embodiment, the invention addresses the shortcomings in the above-mentioned prior technology by presenting an economically-operated, dual-energy hot water supply system. The supply of hot water to users is based on a minimal operating cost.

To achieve the above, the economically-operated, dual-energy hot water supply system comprises, in one embodiment, at least a heat pump heating unit and a gas heating unit. The system includes an insulated water tank equipped with a water temperature sensor, the hot water system is equipped with an ambient temperature sensor, the signal output terminals of the water and ambient temperature sensors are connected to the monitoring input terminal of a centralized controller, whose control output terminal is connected to startup control terminals of the heat pump heating unit and the gas heating unit. The centralized controller can include the following units.

A storage unit used to store the derivation rules of energy efficiency coefficient corresponding to different water and ambient temperatures.

A computation unit used to call the corresponding energy efficiency coefficient from the storage unit according to the water and ambient temperature signals from the detection input terminals. The computation unit calculates the energy consumption of the heat pump heating unit to generate a unit heat at an energy efficiency coefficient and calculates the gas consumption of the gas heating unit to generate a unit heat based on the combustion efficiency of the gas heating unit and the local gas heat value.

An input unit used to input the present electricity price, gas price, and the combustion efficiency of the mentioned gas heating unit and the local gas heat value.

A comparing unit used to compare the power cost of the heat pump heating unit with the gas cost of the gas heating unit, in order to generate the unit heat.

A control unit used to select and start the heat pump heating unit or the gas heating unit based on the most economic rule.

One exemplary operating method for the above-mentioned dual-energy hot water supply system includes the following.

A storage procedure to store the derivation rules of energy efficiency coefficient corresponding to different water and ambient temperatures.

A computation procedure to call the corresponding energy efficiency coefficient from the storage unit according to the water and ambient temperature signals from the detection input terminals, to calculate the energy consumption of the heat pump heating unit to generate a unit heat at the current energy efficiency coefficient, and to calculate the gas consumption of the gas heating unit to generate a unit heat based on the combustion efficiency of the gas heating unit and the local gas heat value.

An input procedure to input the present electricity price, gas price, and the combustion efficiency of the mentioned gas heating unit and the local gas heat value.

A comparing procedure to compare the power cost of the heat pump heating unit with the gas cost of the gas heating unit, in order to generate a unit heat.

A control procedure to select and start the heat pump heating unit or the gas heating unit based on the most economic rule.

With embodiments of this invention, when the ambient and water temperatures are measured and the local electricity and gas prices are input, the invention will put the air source heat pump heating unit or the gas heating unit into operation based on an optimal operating cost rule, which minimizes the operating cost of the hot water system.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

EXAMPLE I

Figure 1:
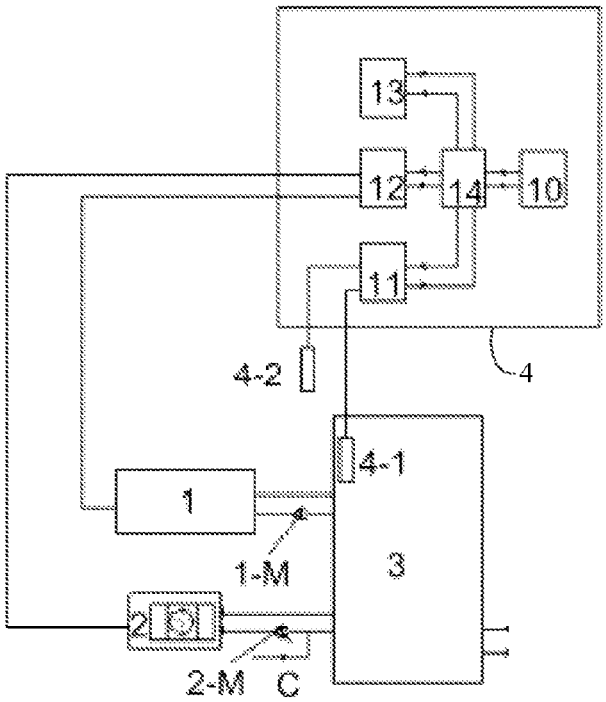
FIG. 1 is a structure diagram of Example I of the invention.
Figure 3A:
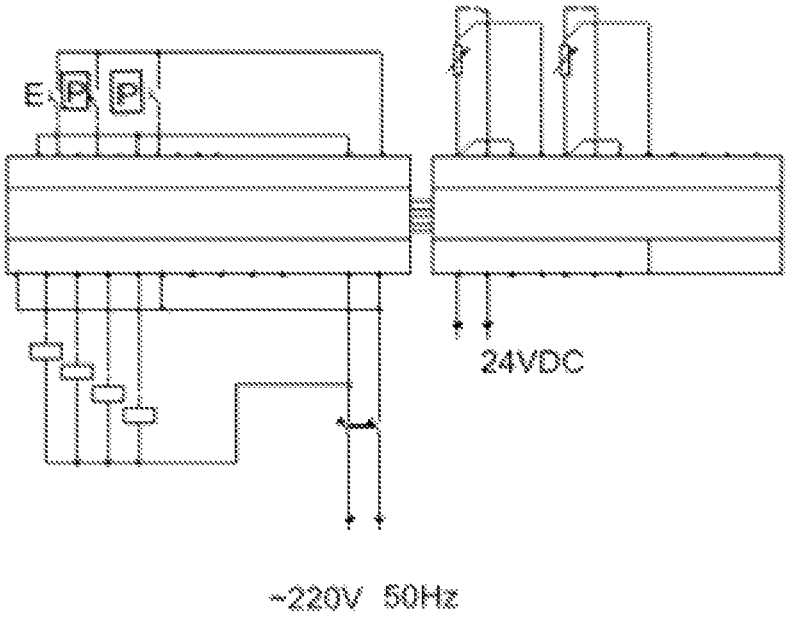
FIGS. 3A and 3B show a schematic circuit diagram for Example I in FIG. 1.
Figure 3B:
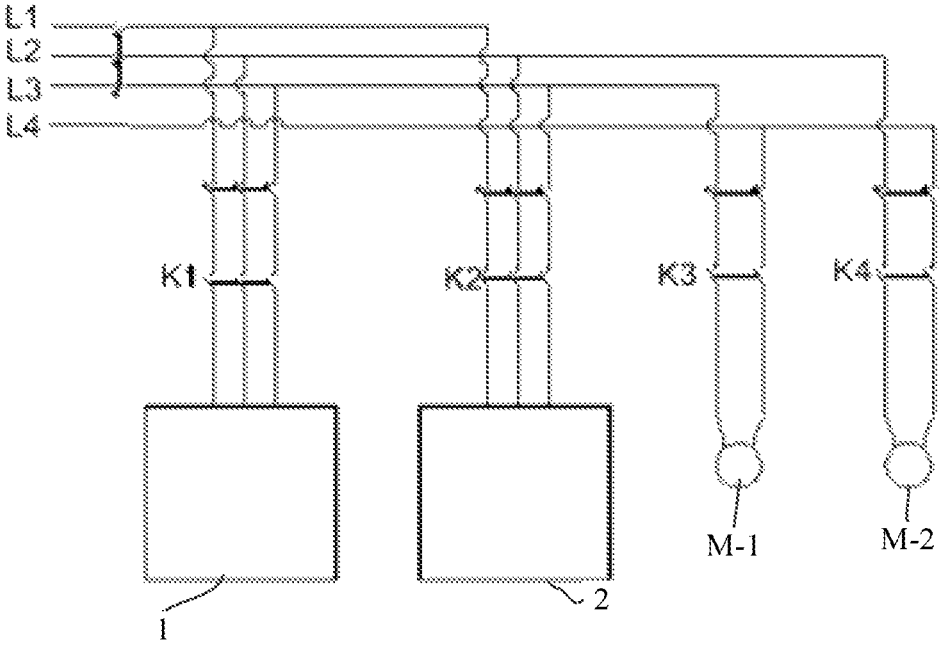

An economically-operated dual-energy hot water supply system is shown in FIG. 1. The system includes a heat pump water heater 1 and a gas water heater 2. The water outlets of the heat pump water heater 1 and the gas water heater 2 are connected by a flow switch respectively to an insulated water tank 3 that supplies hot water to users. The water heaters form a circulation loop with the insulated water tank 3 through circulating water pump 1-M and 2-M, respectively. A water temperature sensor 4-1 is installed at the insulated water tank 3, an ambient temperature sensor 4-2 is installed around the hot water system, and C is a makeup water inlet. The signal output terminals of both sensors and 4-1 and 4-2 are connected to the monitoring input terminal 11 of a programmable logic controller (PLC) 4 that works as a centralized controller through a temperature measurement model. The control output terminal 12 of the controller 4 is connected to relay coils K1 and K2 (FIG. 3B) that work as the startup control terminals of the heat pump water heater 1 and the gas water heater 2, respectively. The control output terminal 12 of the controller 4 is also connected to the control relay coils K3 and K4 of the circulating water pumps 1-M and 2-M, as shown in FIG. 3B, so that it can break and make the corresponding relay contacts L1 L2, L3, and L4, which further control the heat pump water heater 1 and the gas water heater 2 as well as the corresponding circulating water pumps 1-M and 2-M.

Figure 4:
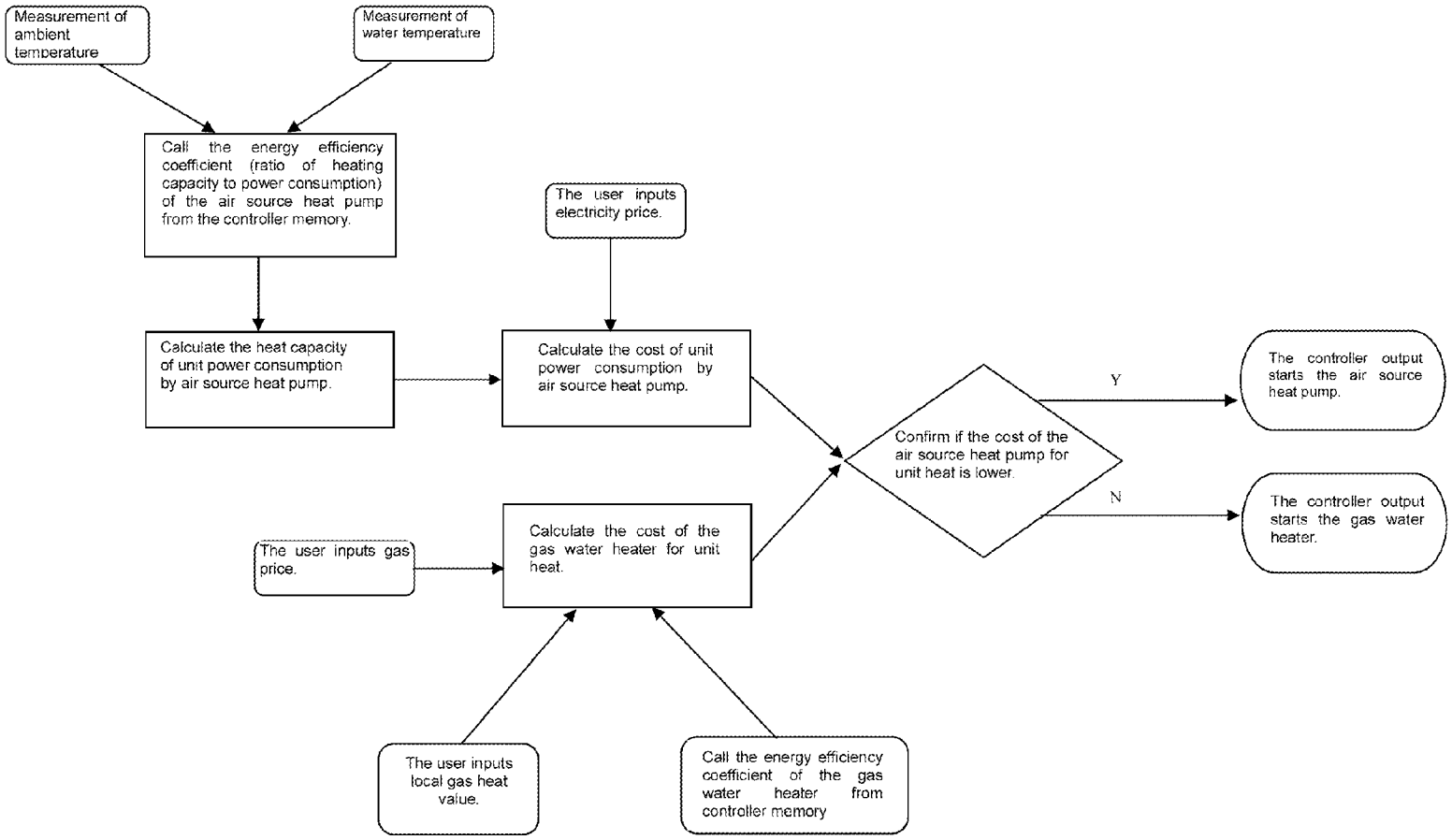
FIG. 4 is a control process block diagram for Example I in FIG. 1.

An exemplary control procedure of the above-mentioned PLC is as follows (refer to FIG. 4).

The storage procedure, performed by a storage unit 10 of the controller 4, stores the derivation rules of an energy efficiency coefficient, which corresponds to different water and ambient temperatures, and includes power consumption of the heat pump water heater to generate a unit heat and gas consumption of the gas water heater to generate a unit heat. In this example, a group of energy efficiency coefficients corresponding to different water and ambient temperatures can be obtained through testing (among them: the energy efficiency coefficient is 4.2 when the ambient temperature is forty degrees Celsius and the water temperature is forty degrees Celsius).

The computation procedure, performed by a computation unit 13 of the controller 4, calls the corresponding energy efficiency coefficient from the storage unit 10 according to the water and ambient temperature signals from the detection input terminals. The procedure calculates the energy consumption of the heat pump water heater and the gas consumption of the gas water heater in order to generate a unit heat at the current energy efficiency coefficient. In one example, the water and ambient temperature inputs are forty degrees Celsius and forty degrees Celsius, respectively, based on which, the energy efficiency coefficient 4.2 is called. The energy consumption of the heat pump water heater to generate 1 MJ heat is further calculated: 1000/(4.2*3600)=0.06614 kWh. In addition, the gas consumption of the gas water heater to generate 1 MJ heat according to the combustion efficiency of the gas heating unit and the local gas heat value (e.g., a combustion heating value for a gas) is calculated:

$$1/(36.5*0.85)=0.3223\ m^3.$$

The input procedure inputs the present electricity and gas prices, which are 0.75 RMB/kWh (0.1166 $/kWh) for electricity price and 2.2 RMB/$m^3$ (0.3419 $/kWh) for gas price, in one example. The combustion efficiency of the mentioned gas heating unit, which is 0.85 in one example, and the local gas heat value.

The comparing procedure, performed by a comparison unit 14 of the controller 4, compares the power cost of the heat pump water heater with the gas cost of the gas water heater to generate a unit heat. In the above example, the power cost of the heat pump water heater to generate 1 MJ heat is 0.06614*0.75=0.0496 RMB/MJ (0.0077 $/MJ), which is lower than the gas cost of the gas water heater to generate 1 MJ heat: 2.2*0.3223=0.0709 RMB/MJ (0.0110 $/MJ).

The control procedure selects and starts the heat pump heating unit or the gas heating unit based on the most economic rule. In the above example, the control procedure opens the flow switch of the heat pump water heater and starts the corresponding circulating water pump.

Therefore, when the ambient and water temperatures are measured and the local electricity and gas prices are input, the invention puts the air source heat pump water heater (or the gas water heater) into operation based on an optimal operating cost rule, so that the procedure minimizes the operating cost of the whole hot water system.

EXAMPLE II

Figure 2:
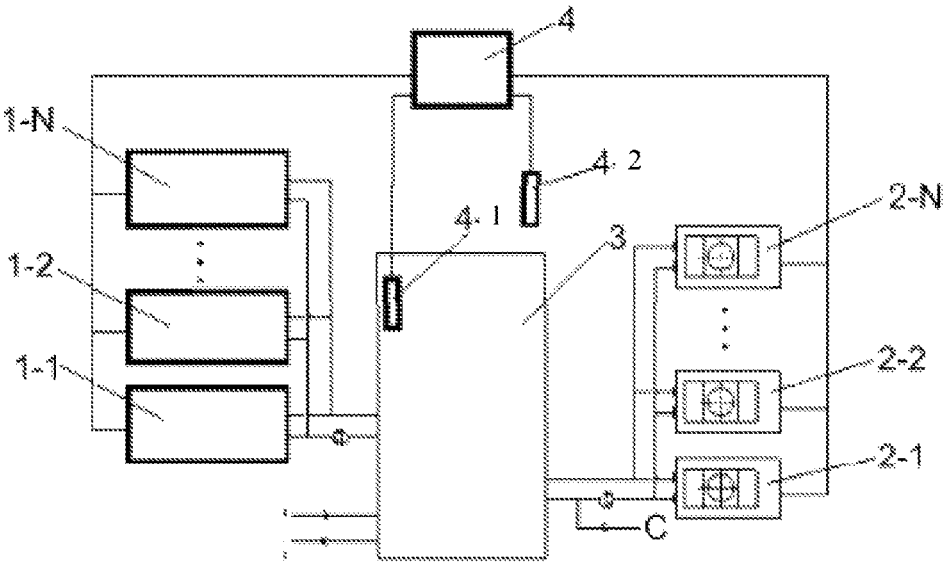
FIG. 2 is a structure diagram of Example II of the invention.

An economically-operated, dual-energy hot water supply system in this example is shown in FIG. 2. The system includes a group of heat pump water heaters 1-1, 1-2 . . . 1-*n* in parallel and a group of gas water heaters 2-1, 2-2 . . . 2-*n* in parallel. The water outlets of the heat pump water heater group and the gas water heater group are connected through flow switches, respectively, to an insulated water tank 3 that supplies hot water to users. The water heater groups form a circulation loop with the insulated water tank 3 through circulating water pumps, respectively. A water temperature sensor 4-1 is installed at the insulated water tank 3, and an ambient temperature sensor 4-2 is installed around the hot water system. The signal output terminals of both sensors are connected to the monitoring input terminal of a centralized controller 4, whose control output terminals 12 are connected to the startup control terminals K1 and K2 of the heat pump water heater group 1 and the gas water heater group 2, respectively (refer to FIGS. 1, 3A, and 3B). The control procedures of this example are the same with that of Example I.

EXAMPLE III

Figure 5:
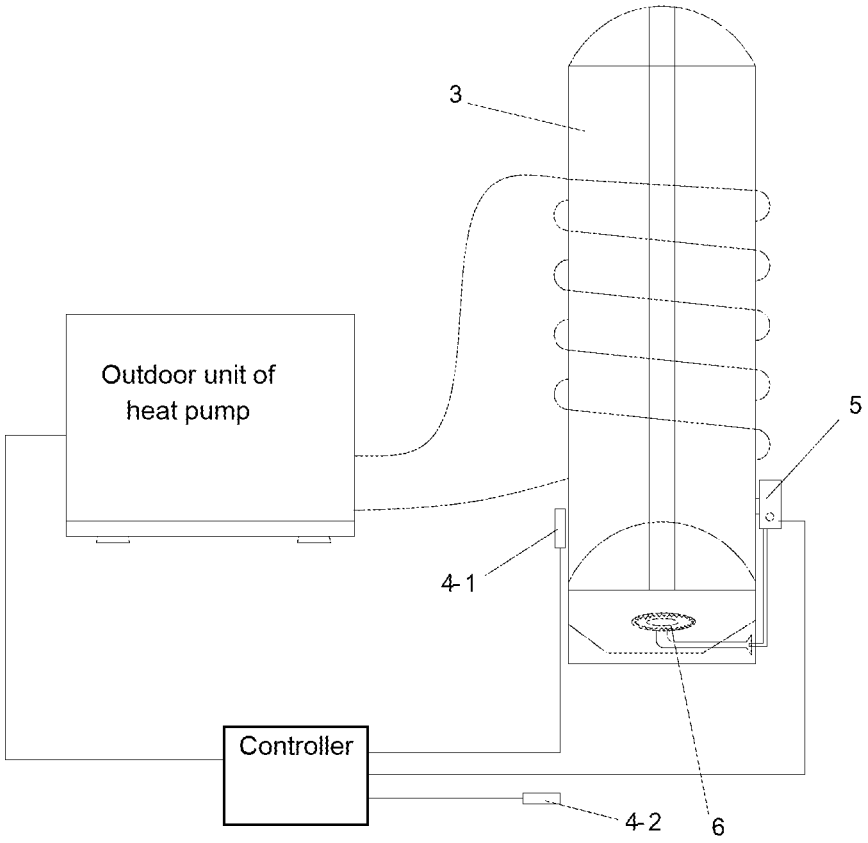
FIG. 5 is a structure diagram of Example III of the invention.

The economically-operated dual-energy hot water supply system in this example is shown in FIG. 5. Some differences from the above examples are that the heat exchange coil of a heat pump heating unit is wound around the insulated water tank 3 and the burner 6 of a gas heating unit is installed directly on the bottom of the insulated water tank 3, thus to supply heat to the insulated water tank 3. However, in the above examples, heat is supplied to the insulated water tank 3 indirectly through the heat pump water heater and gas water heater. In Example III the hot water supply system includes a gas valve 5—the startup control terminal of the gas heating unit. The operating principle and control procedures of this example are similar to that of Example I.

Thus, the invention provides, among other things, a new and useful economically-operated, dual-energy hot ware supply system and method of operating the same. Various features and advantages of the invention are set forth in the following claims.

What is claimed is:

1. An economically operated, dual-energy hot water supply system comprising:

A first heat source of a first type, the first heat source being driven by electricity;

A second heat source of a second type different than the first type, the second heat source being gas fired;

A first temperature sensor;

A second temperature sensor;

A controller coupled to the first and second temperature sensors and to the first and second heat sources, the controller including A storage unit storing a plurality of first predetermined temperature values, a plurality of second predetermined temperature values, a plurality of energy efficiency coefficients, and a derivation rule including an association for each of the plurality of energy efficiency coefficients with one of the plurality of first predetermined temperature values and one of the plurality of second predetermined temperature values, A computation unit receiving one of the plurality of energy efficiency coefficients, the received energy efficiency coefficient being associated with a first measured value resulting from the first temperature sensor and a second measured value resulting from the second temperature sensor, determining a first energy consumption of the first heat source to generator a unit heat with the received energy efficiency coefficient, and determining a second energy consumption of the second heat source to generate the unit heat, wherein the first energy consumption of the first heat source to generate a unit heat is equal to 1000 divided by a first product of 3600 multiplied by the received energy efficiency coefficient, and wherein the second energy consumption of the second heat source to generate a unit heat is equal to 1 divided by a second product of a combustion heating value for a gas multiplied by a combustion efficiency, An input unit receiving a first price related to operating the first heat source for the unit heat and receiving a second price related to operating the second heat source for the unit heat, A comparing unit comparing a first power cost of the first heat source with a second power cost of the second heat source, the first power cost being based on the first energy consumption and the first price, the second power cost being based on the second energy consumption and the second price, A control unit selecting and controlling the first or second heat source based on the comparison result.

2. The system of claim 1 wherein the first heat source includes a heat pump and the second heat source includes a gas burner.

3. The system of claim 2 wherein the system further comprises a water tank and wherein the first temperature sensor is an ambient temperature sensor and the second temperature sensor measures a temperature associated with water inside the water tank.

4. The system of claim 1 wherein the first heat source consists of a first plurality of water heat sources of the first type and the second heat source consists of a second plurality of heat sources of the second type.

5. An economically operated, duel-energy hot water supply system comprising:

An electric heat pump;

A gas fired burner;

A water tank;

A tank temperature sensor;

An ambient temperature sensor;

A controller coupled to the tank temperature sensor, the ambient temperature sensor, the electric heat pump and the gas-fired burner, the controller including A storage unit storing a plurality of first predetermined temperature values, a plurality of second predetermined temperature values, a plurality of energy efficiency coefficients, and a derivation rule including an association for each of the plurality of energy efficiency coefficients with the one of the plurality of first predetermined temperature values and one of the plurality of second predetermined temperature values, A computation unit receiving one of the plurality of energy efficiency coefficients, the received energy efficiency coefficient being associated with a first measured value resulting from the tank temperature sensor and a second measured value resulting from the ambient temperature sensor, receiving a combustion efficiency, receive a gas heat value, determining a first energy consumption of the heat pump to generate a unit heat with the received energy efficiency coefficient, and determining a second energy consumption of the gas-fired burner to generate the unit heat based on the combustion efficiency and the gas heat value, wherein the first energy consumption is equal to 1000 divided by a first product of 3600 multiplied by the received energy efficiency coefficient, and wherein the second energy consumption is equal to 1 divided by a second product of a combustion heating value for a gas multiplied by the combustion efficiency, An input unit receiving a first price related to operating the heat pump for the unit heat and receiving a second price related to operating the gas-fired burner for the unit heat, A comparing unit comparing a first power cost of the heat pump with a second power cost of the gas-fired burner, the first power cost being based on the first energy consumption and the first price, the second power cost being based on the second energy consumption and the second price, A control unit selecting and controlling the heat pump or gas-fired burner based on the comparison result.

6. The system of claim 5 wherein the heat pump consists of a first plurality of heat pumps and the gas-fired burner consists of a second plurality of gas-fired burners.

7. A method of economically operating a dual energy hot water supply system having a first heat source of a first type, the first heat source being driven by electricity, and a second heat source of a second type different than the first type, the second heat source being gas fired, the method comprising:

Receiving a first measured value from a first temperature sensor;

Receiving a second measured value from a second temperature sensor;

Storing, in a storage unit, a plurality of first predetermined temperature values, a plurality of second predetermined temperature values, a plurality of energy efficiency coefficients, and a derivation rule including an association for each of the plurality of energy efficiency coefficients with one of the plurality of first predetermined temperature values and one of the plurality of second predetermined temperature values;

Receiving, from the storage unit, one of the plurality of energy efficiency coefficients, the received energy efficiency coefficient determined by analyzing the first measured value and the second measured value;

Determining a first energy consumption of the first heat source to generate a unit heat with the received energy efficiency coefficient, the first energy consumption being equal to 1000 divided by a first produce of 3600 multiplied by the received energy efficiency coefficient;

Determining a second energy consumption of the second heat source to generate the unit heat, the second energy consumption being equal to 1 divided by a second product of a combustion heating value for a gas multiplied by a combustion efficiency;

Comparing a first power cost of the first heat source with a second power cost of the second heat source, the first power cost being based on the first energy consumption and a price for the unit heat, and the second power cost being based on the second energy consumption and a second price for the unit heat;

Controlling the first heat source or the second heat source based on the results of the comparison.

8. The method of claim 7 further comprising receiving the first price related to operating the first heat source for the unit heat and receiving the second price related to operating the second heat source for the unit heat.

9. The method of claim 7 wherein the first heat source includes a heat pump and the second heat source includes a gas burner.

10. The method of claim 9 wherein the system further includes a water tank and wherein the first temperature sensor is an ambient temperature sensor and the second temperature sensor measures a temperature associated with water inside the water tank.

11. The method of claim 7 wherein the first heat source consists of a first plurality of water heat sources of the first type and the second heat source consists of a second plurality of heat sources of the second type.

* * * * *